United States Patent [19]

Scholz et al.

[11] Patent Number: 4,590,986

[45] Date of Patent: May 27, 1986

[54] ROLLER GUIDE FOR CONTINUOUS CASTING INSTALLATION

[75] Inventors: Heinrich Scholz, Grevenbroich; Günter Flemming, Erkrath, both of Fed. Rep. of Germany

[73] Assignee: SMS Concast Inc., Montvale, N.J.

[21] Appl. No.: 573,057

[22] Filed: Jan. 23, 1984

[30] Foreign Application Priority Data

Feb. 2, 1983 [DE] Fed. Rep. of Germany ..... 3303386

[51] Int. Cl.[4] ..... B22D 11/12

[52] U.S. Cl. ..... 164/448

[58] Field of Search ..... 164/447, 448, 441, 442, 164/484

[56] References Cited

U.S. PATENT DOCUMENTS

| | | | |
|---|---|---|---|
| 4,197,904 | 4/1980 | Streubel et al. | 164/448 |
| 4,432,407 | 2/1984 | Scheurecker et al. | 164/448 |
| 4,465,121 | 8/1984 | Vaterlaus | 164/442 |

FOREIGN PATENT DOCUMENTS

| | | | |
|---|---|---|---|
| 7630425 | 6/1978 | France | 164/448 |

*Primary Examiner*—Nicholas P. Godici

*Attorney, Agent, or Firm*—Tobias Lewenstein; Peter K. Kontler

[57] ABSTRACT

A roller guide for use in a continuous casting installation for steel is divided into segments. Each segment includes a fixed guide member which rests on a base and a movable guide member which is supported by the fixed guide member. The guide members carry rollers which cooperate to define a path for a continuously cast steel strand. The fixed guide member has a series of hollow columns which are aligned with respective tubular elements provided on the movable guide member. Spacers for adjusting the distance between the rollers are disposed between the columns and tubular elements. A tie rod extends through each column and has a first end located externally of but adjacent to the respective column. The first end of each tie rod has a passage which registers with a corresponding passage in the base. Each pair of registering passages receives a locking pin. The locking pins connect the tie rods to the base and indirectly connect the fixed guide member to the base via the tie rods. Each tie rod has a second end located in one of the tubular elements of the movable guide member. A compression spring in each tubular element reacts against the associated tie rod and against the movable guide member thereby urging the movable guide member towards the fixed guide member. The action of the compression springs also causes the locking pins, and hence the fixed guide member, to be braced against the base. A piston-and-cylinder unit mounted inside each tubular element is arranged to act against the adjacent end face of the associated tie rod counter to the respective compression spring.

22 Claims, 2 Drawing Figures

ROLLER GUIDE FOR CONTINUOUS CASTING INSTALLATION

BACKGROUND OF THE INVENTION

The invention relates generally to a roller guide.

More particularly, the invention relates to a roller guide for use in a continuous casting installation, especially an installation for the continuous casting of steel.

A conventional roller guide used in installations for the continuous casting of steel has two oppositely disposed rows of guide rollers. The rollers cooperate to define a path for a continuously cast steel strand or ingot issuing from a mold. Some of the guide rollers are driven in order to advance the strand while the remaining rollers are non-driven or idler rollers.

The roller guide is divided into segments. Each segment includes a fixed guide member made up of a carrier or beam which supports a plurality of rollers of one of the rows. The carrier of the fixed guide member is secured to a base frame or support. The fixed guide member of each segment is provided with a plurality of columns which engage a movable guide member constituting part of the respective segment. The movable guide member is made up of a carrier or beam which supports a plurality of rollers of the row opposite that supported by the fixed carriers.

The fixed and movable guide members of each segment are connected by a plurality of tie rods. A spring reacts against each tie rod and against the associated movable guide member so as to urge the latter against the columns of the corresponding fixed guide member. The movable guide member is arranged to be displaced away from the strand and away from the respective fixed guide member against the action of the corresponding springs. A piston-and-cylinder unit is associated with each tie rod and is designed to oppose the stress which is generated in the tie rod by the respective spring.

A roller guide of the type outlined above is disclosed in the West German Offenlegungsschrift No. 29 42 144. Here, the piston-and-cylinder units which oppose the springs are mounted on the fixed guide members beneath the end faces of the tie rods. The sides of the movable guide members are provided with lugs which carry special lifting units or cylinders for displacing the movable guide members away from the strand or away from the fixed guide members, e.g. when a cold strand is to be removed from the roller guide or when the thickness of the strand is to be changed. The fixed guide members are secured to the base frame by special, hand-operated connecting elements.

OBJECTS AND SUMMARY OF THE INVENTION

It is an object of the invention to provide a roller guide having a simpler construction than heretofore.

Another object of the invention is to provide a roller guide which does not require special lifting units to displace the movable guide member.

A further object of the invention is to provide a roller guide which is well-protected against overload.

An additional object of the invention is to provide a roller guide which may be readily relieved of load.

It is also an object of the invention to provide a simplified roller guide for use in continuous casting installations and to design the roller guide with hydraulic mechanisms which cooperate with fixed stops and serve to adjust the thickness of the continuously cast strand. The hydraulic mechanisms are to be arranged so as to be entirely or largely free of pressure during casting and are to be well-protected against overload and readily relieved of load.

Yet another object of the invention is to provide a roller guide which may be secured to a base in a simpler manner than heretofore.

Still a further object of the invention is to provide a relatively simple roller guide having interchangeable segments.

An additional object of the invention is to provide a roller guide having segments which may be rapidly secured to and disconnected from a base in order to facilitate segment exchange.

The preceding objects, as well as others which will become apparent as the description proceeds, are achieved by the invention.

One aspect of the invention resides in a roller guide having a first guide member which includes a first carrier and at least one first guide roller supported by the first carrier. The roller guide further comprises a second guide member which includes a second carrier and at least one second guide roller supported by the second carrier. The second guide member is movable towards and away from the first guide member and is mounted on the latter in such a manner that the first and second rollers cooperate to define a guide passage. A plurality of rods are arranged to transmit stresses between the first and second guide members. First means is arranged to act on the rods and to urge the second guide member towards the first guide member. Second biasing means is provided for moving the second guide member away from the first guide member against the action of the first biasing means. Each of the rods has an end face in the region of the second guide member and the second biasing means is arranged to bear against these end faces.

The roller guide of the invention is particularly well-suited for use in continuous casting installations, especially installations for the continuous casting of steel.

The arrangement of the second biasing means so as to act against those end faces of the rods which are located in the region of a movable guide member, namely, the second guide member, makes it possible to eliminate special lifting or displacing units for the movable guide member. Preferably, the second biasing means is disposed in the region of the second or movable guide member.

The first guide member may be fixedly mounted on a base frame or support. It is preferred for the first or fixed guide member to be releasably connected to the support via the rods, that is, the fixed guide member is preferably connected with the rods which, in turn, are releasably secured to the support by suitable connecting means. Employment of the rods for the additional function of securing the fixed guide member to the base frame or support makes it possible to eliminate special connecting elements for connecting the fixed guide member with the support. Furthermore, by indirectly connecting the fixed guide member with the support via the rods, the operation of replacing a segment of the roller guide may be accelerated.

Each of the guide members may include a plurality of rollers which are arranged in a row. The two rows are then disposed opposite one another so as to define a path for an article, e.g. a continuously cast steel strand, passing through the roller guide. The rollers may include driven as well as non-driven or idler rollers.

The fixed guide member may be designed with a plurality of columns. The movable guide member is then urged towards and supported on the columns.

The biasing means which acts on the rods and urges the movable guide member towards the fixed guide member may comprise a plurality of springs each of which is associated with one of the rods and places the respective rod in tension. The second biasing means which operates to displace the movable guide member away from the fixed guide member may comprise a plurality of piston-and-cylinder units each of which is associated with one of the rods and is arranged to bear against the appropriate end face of the respective rod. Preferably, the piston-and-cylinder units are hydraulic units.

The rods may be formed with locking passages or slots for the purpose of connecting the rods with the base frame or support for the fixed guide member. The locking passages are designed to register with corresponding locking passages in the support. The rods are then connected with the support by removable locking elements which are received in the registering locking passages. Advantageously, the locking passages are located in the region of the fixed guide member.

It is possible to provide centering elements between the fixed guide member and its support. The centering elements, which are preferably annular, each have a centering opening. The rods extend through the fixed guide member and are received in respective ones of the centering openings.

Each of the rods may be provided with an abutment in the region between the fixed guide member and the associated centering element. The abutments prevent the fixed guide member from sliding off the rods when a segment of the roller guide comprising the fixed guide member and the movable guide member is lifted or transported.

The movable guide member may be provided with tubular elements on opposite sides thereof and those ends of the rods which are acted upon by the piston-and-cylinder units may project into ones of the tubular elements. The springs which urge the movable guide member towards the fixed guide member may be disposed in the tubular elements around the ends of the rods. The piston-and-cylinder units which oppose the springs and are arranged to bear against the end faces of the rods may likewise be located in or on the tubular elements.

Each of the tubular elements of the movable guide member may be aligned with a column of the fixed guide member. The rods are here disposed inside the aligned columns and tubular elements.

Movable spacing elements may be interposed between the columns of the fixed guide member and the corresponding tubular elements of the movable guide member. This makes it possible to adjust the thickness of a strand in a continuous casting installation.

Another aspect of the invention resides in a roller guide comprising a first guide member which rests on a support. The first guide member includes a first carrier and at least one first guide roller supported by the first carrier. The roller guide further comprises a second guide member which includes a second carrier and at least one second guide roller supported by the second carrier. The second guide member is movable towards and away from the first guide member and is mounted on the latter in such a manner that the first and second rollers cooperate to define a guide passage. A plurality of rods are arranged to transmit stresses between the first and second guide members. First biasing means is arranged to act on the rods and to urge the second guide member towards the first guide member. Second biasing means is provided to move the second guide member away from the first guide member against the action of the first biasing means. The roller guide includes connecting means for releasably connecting the rods, and thereby the first guide member, to the support on which the first guide member rests. In other words, the first guide member is indirectly connected to its support via the rods.

The novel features which are considered as characteristic of the invention are set forth in particular in the appended claims. The improved roller guide itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
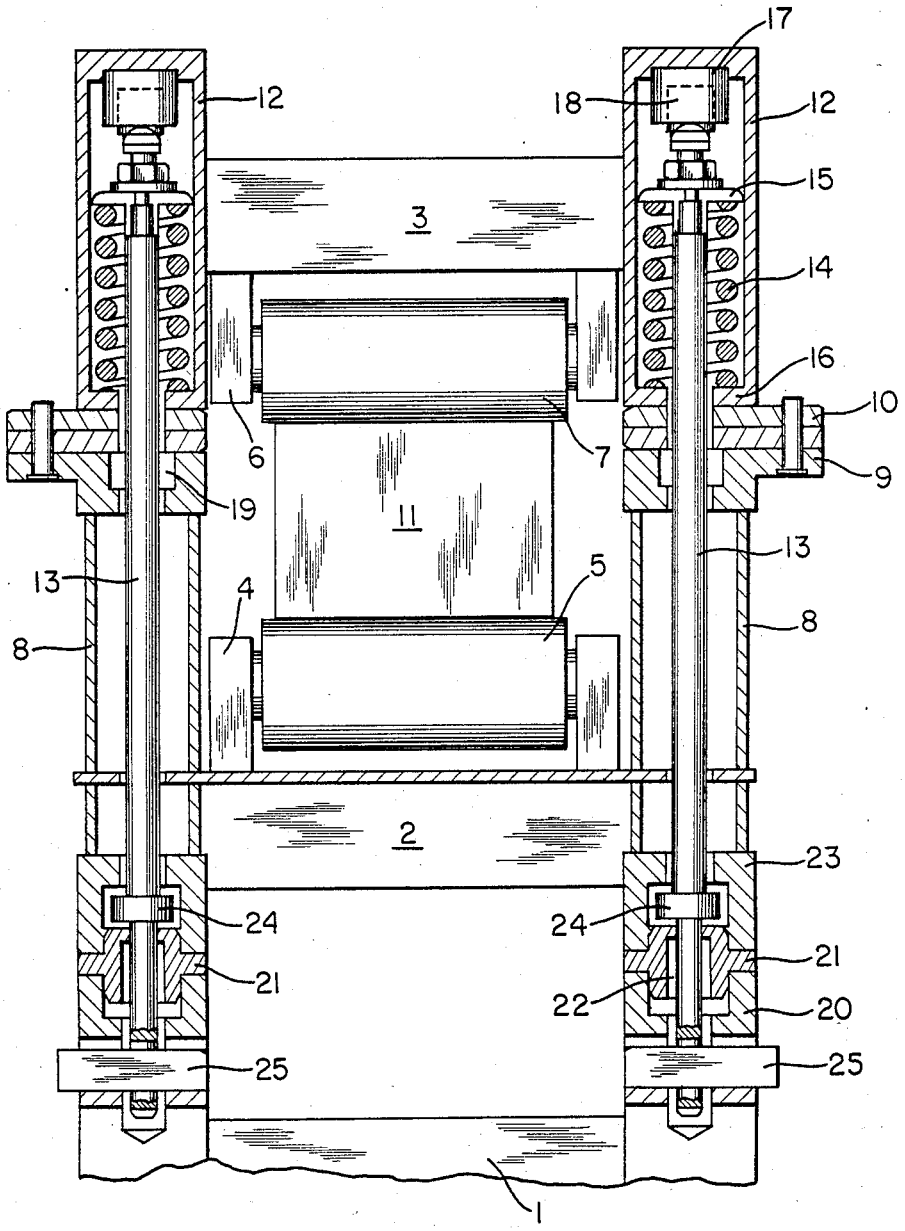
FIG. 1 is a cross section of a roller guide segment according to the invention.
Figure 2:
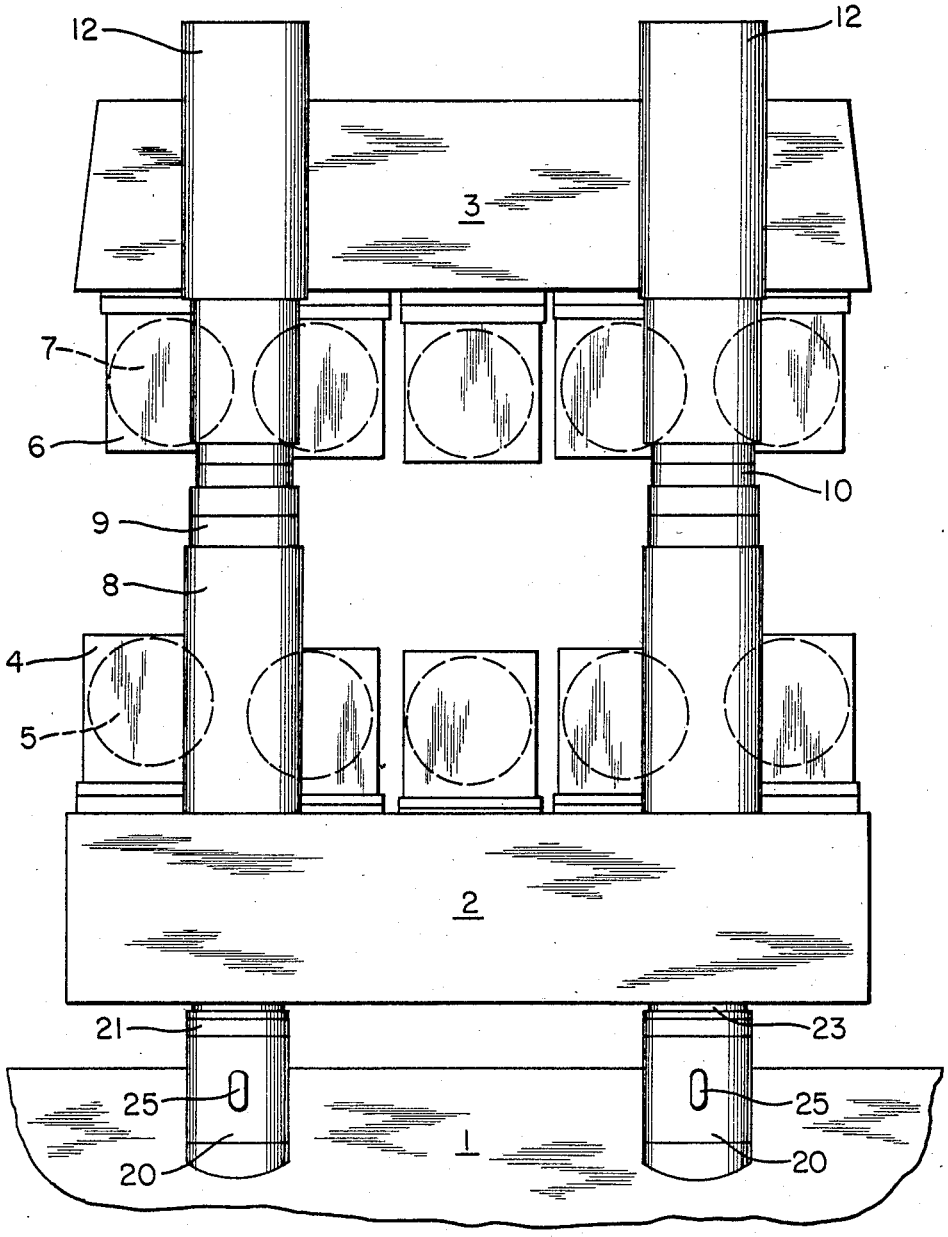
FIG. 2 is a side view of the segment of FIG. 1.

In FIGS. 1 and 2, the reference numeral 1 represents a base or base frame 1 constituting part of an installation for the continuous casting of steel. The continuous casting installation is here assumed to be of the curved-mold type and the base 1 accordingly has a curved portion immediately downstream of the mold. Since the base 1 is mostly conventional, only that part of the base 1 necessary for an understanding of the invention has been illustrated.

The base 1 supports a roller guide or roller apron for guiding and advancing a continuously cast steel strand 11 issuing from the mold of the continuous casting installation. The roller guide is segmented, that is, the roller guide is divided into a plurality of individual segments which are aligned with one another so as to define a path of travel for the strand 11.

Only one of the segments of the roller guide is illustrated in the drawings. The segment has a fixed guide member which rests on the base 1. The fixed guide member comprises a carrier or beam 2 which is mounted on the base 1 and carries several pairs of cooperating bearings 4. Each pair of bearings 4 rotatably supports a roller 5 which extends transversely of the direction of advance of the strand 11. As most clearly seen in FIG. 2, the rollers 5 are arranged in a row extending in the direction of travel of the strand 11. The rollers 5 are aligned with corresponding rollers of the other segments of the roller guide.

The segment illustrated in FIGS. 1 and 2 also has a movable guide member which is supported by the fixed guide member and includes a carrier or beam 3 which carries several pairs of cooperating bearings 6. The bearings 6 rotatably support a series of rollers 7 extending transversely of the direction of travel of the strand 11. As again most clearly seen in FIG. 2, the rollers 7 are arranged in a row extending in the direction of travel of the strand 11. The rollers 7 are aligned with corresponding rollers on the other segments of the roller guide. The row defined by the rollers 7 is spaced from and disposed opposite the row defined by the rollers 5 so that the rollers 5 and 7 cooperate to define a guide path or passage for the strand 11. The distance between the rollers 5 and 7 conforms to the thickness of the strand 11.

The rollers 5, 7 may include non-driven or idler rollers as well as driven rollers for advancing the strand 11. The driven rollers are rotated by suitable drive mechanisms which have not been illustrated since they do not form part of the invention per se and may be conventional.

The fixed carrier 2 has four hollow columns 8 which are provided with covers 9. Two of the columns 8 are located on either side of the path of travel of the strand 11. The columns 8 on the opposite sides of the path of travel of the strand 11 are paired, that is, one of the columns 8 on each side is disposed opposite one of the columns 8 on the other side. A bearing ring 19 is mounted in each of the covers 9. Each of the covers 9 further carries a series of spacers or spacing elements 10. The spacers 10 are pivotally mounted on the covers 9, e.g. via pivot pins as shown in FIG. 1. In FIGS. 1 and 2, the spacers 10 are in alignment with the respective columns 8. Each of the spacers 10 may be individually pivoted from this position of alignment to a position in which it is located to the side of the respective column 8. The function of the spacers 10 is to permit the distance between the rollers 5 and 7 to be adjusted to the thickness of the strand 11.

The movable carrier 3 is provided with four tubular or hollow elements 12. Each of the tubular elements 12 is in alignment with one of the columns 8. The tubular elements 12 bear against those of the respective spacers 10 which are in a position of alignment with the corresponding columns 8.

Four tie rods or tension rods 13 are provided to transmit stresses between the fixed and movable guide members. Each of the tie rods 13 extends through one of the columns 8 and into the aligned tubular element 12 via the associated bearing ring 19 and suitable openings provided in the respective covers 9 and spacers 10. One end of each of the tie rods 13, which is the upper end as viewed in the drawings, is located inside the respective tubular element 12. A flange 15 is formed on the upper end of each tie rod 13. Each of the tubular elements 12 has an end wall 16 which is spaced from the flange 15 of the associated tie rod 13 and engages the corresponding spacer 10. A compression spring 14 is disposed around the upper end of each tie rod 13 and bears against the respective flange 15 and corresponding end wall 16. The compression springs 14 cause tensile stresses to be generated in the tie rods 13.

The tie rods 13 function to guide the movable guide member during displacement thereof.

A piston-and-cylinder unit is mounted inside each of the tubular elements 12. As viewed in the drawings, the respective tubular elements 12 have upper end walls disposed above the upper ends of the tie rods 13 and located opposite the end walls 16 which bear against the spacers 10. Each of the piston-and-cylinder units comprises a cylinder 17 which is mounted on the upper end wall of the associated tubular element 12. The respective piston-and-cylinder units further comprise pistons 18 which are arranged to bear against the upper end faces of the corresponding tie rods 13. The piston-and-cylinder units 17, 18 are here assumed to be hydraulic units and are connected with a suitable source of hydraulic fluid which has not been illustrated since it does not form part of the invention per se.

The compression springs 14 constitute a biasing means for urging the movable guide member towards the fixed guide member. The piston-and-cylinder units 17, 18, which act counter to the compression springs 14, constitute a biasing means for moving the movable guide member away from the fixed guide member against the action of the compression springs 14.

Four mounts or mounting elements 20 for positioning the fixed guide member are secured to the base 1. Each of the mounts 20 is in register with one of the columns 8 of the fixed guide member. As viewed in the drawings, the lower ends of the tie rods project below the fixed guide member and each of the mounts 20 is provided with an opening designed to receive the lower end of the respective tie rod 13. The respective mounts 20 support annular centering elements 21. Each of the centering elements 21 has an internal guide sleeve 22 which receives the corresponding tie rod 13. The centering elements 21 serve to center or position the roller guide segment relative to the mold of the continuous casting installation.

The carrier 2 of the fixed guide member is provided with a base ring 23 below each of the columns 8. The base rings 23 are seated against the centering elements 21. Each of the base rings 23 has an opening to permit passage of the respective tie rod 13 therethrough. The tie rods 13 are each formed with an annular collar or abutment 24 which is disposed between the associated centering element 21 and base ring 23.

The lower end of each tie rod 13 is provided with a radial locking passage or slot, that is, a locking passage or slot extending transversely of the direction of travel of the strand 11, in the region of the fixed guide member. The locking passages in the tie rods 13 register with corresponding radial locking passages or slots formed in the respective mounts 20. The registering locking passages in the tie rods 13 and mounts 20 receive removable locking pins or elements 25. The locking pins 25 establish a direct releasable connection between the tie rods 13 and the base 1. The locking pins 25 also establish an indirect releasable connection between the base 1 and the fixed guide member. In other words, the fixed guide member is indirectly coupled to the base 1 via the tie rods 13. Thus, the tie rods 13 serve the dual function of transmitting stresses between the fixed and movable guide members and of establishing a connection between the fixed guide member and the base 1.

In operation, the spring-loaded tie rods 13 urge the movable guide member against the spacers 10 and towards the columns 8 of the fixed guide member during a casting process. At the same time, the compression springs 14 cause the fixed guide member to be braced against the base 1. The piston-and-cylinder units 17, 18 generally need not exert pressure on the upper end faces of the tie rods 13 while the casting process proceeds normally.

If the movable guide member is to be displaced away from the fixed guide member, e.g. in the event that the strand 11 must be removed from the roller guide when cold or in the event that the thickness of the strand 11 is to be changed, the piston-and-cylinder units 17, 18 are supplied with pressurized hydraulic fluid. The pistons 18 then push down on the upper end faces of the tie rods 13. This causes the movable guide member to move upwards. If, for example, the strand 11 was stuck in the roller guide due to excessive cooling, upward movement of the movable guide member frees the strand 11 for withdrawal from the roller guide. Furthermore, the pressure exerted on the upper end faces of the tie rods 13 by the pistons 18 releases the locking pins 25 which were previously urged into engagement with the mounts 20 by the action of the compression springs 14. This enables the locking pins 25 to be removed from the locking passages.

Once the locking pins 25 have been withdrawn from the locking passages, the roller guide segment may be removed from the base 1. The collars 24 prevent the fixed guide member from sliding off the tie rods 13 when the roller guide segment is lifted or transported.

The arrangement of the piston-and-cylinder units 17, 18 so as to act on those end faces of the tie rods 13 located in the region of the movable guide member eliminates the need for separate displacing units to move the movable guide member. By using the tie rods 13 to perform an additional function, namely, to establish a connection between the fixed guide member and the base 1, it also becomes possible to eliminate special connecting elements for connecting the fixed guide member to the base 1. Moreover, the operation of replacing a segment may be accelerated.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of out contribution to the art and, therefore, such adaptations should and are intended to be comprehended within the meaning and range of equivalence of the appended claims.

We claim:

1. A roller guide, particularly for use in continuous casting installations for steel, said guide comprising:

(a) a first guide member including a first carrier, and at least one first guide roller supported by said first carrier, said first guide member resting on a support;

(b) a second guide member including a second carrier, and at least one second guide roller supported by said second carrier, said second guide member being mounted on said first guide member in such a manner that said first and second rollers cooperate to define a guide passage, and said second guide member being movable towards and away from said first guide member;

(c) a plurality of rods arranged to transmit stresses between said first and second guide members, each of said rods having an end face in the region of said second guide member;

(d) first biasing means arranged to act on said rods and to urge said second guide member towards said first guide member;

(e) second biasing means for moving said second guide member away from said first guide member against the action of said first biasing means, said second biasing means being arranged to bear against said end faces; and (f) connecting means for releasably connecting said rods, and thereby said first guide member, to the support.

2. The guide of claim 1, wherein said second biasing means is disposed in the region of said second guide member.

3. The guide of claim 1, the support and said rods having registering locking passages; and wherein said connecting means comprises a plurality of locking elements designed to be received in said registering locking passages.

4. The guide of claim 3, wherein said registering locking passages are located in the region of said first guide member.

5. The guide of claim 1, comprising a plurality of additional first guide rollers on said first carrier, and a plurality of additional second guide rollers on said second carrier, said first guide rollers being arranged in a first row, and said second guide rollers being arranged in a second row disposed opposite said first row.

6. The guide of claim 1, wherein at least one of said rollers is driven.

7. The guide of claim 1, wherein at least one of said rollers is an idler roller.

8. The guide of claim 1, wherein said first guide member is fixed.

9. The guide of claim 1, wherein said first guide member comprises a plurality of columns and said second guide member is supported on said columns.

10. The guide of claim 1, wherein said first biasing means comprises a plurality of springs each of which acts on one of said rods.

11. The guide of claim 1, wherein said second biasing means comprises a plurality of piston-and-cylinder units each of which is arranged to bear against one of said end faces.

12. The guide of claim 1, wherein said second guide member comprises a plurality of tubular elements and each of said rods has an end portion which is provided with the respective end face and is received in one of said tubular elements.

13. The guide of claim 12, wherein said tubular elements include a pair of tubular elements disposed on opposite sides of said second guide member.

14. The guide of claim 12, wherein said first biasing means comprises a plurality of first biasing elements each of which surrounds on one of said end portions.

15. The guide of claim 1, wherein said first guide member comprises a plurality of columns and said second guide member comprises a plurality of tubular elements each of which is aligned with one of said columns.

16. The guide of claim 15, comprising spacing elements movably interposed between each of said columns and the respective tubular element.

17. The guide of claim 15, wherein each of said rods is disposed inside one of said columns and the aligned tubular element.

18. The guide of claim 1, wherein said rods include a pair of rods disposed on opposite sides of said guide members.

19. A roller guide, particularly for use in continuous casting installations for steel, said guide comprising:

(a) a first guide member including a first carrier, and at least one first guide roller supported by said first carrier, said first guide member resting on a support;

(b) a second guide member including a second carrier, and at least one second guide roller supported by said second carrier, said second guide member being mounted on said first guide member in such a manner that said first and second rollers cooperate to define a guide passage, and said second guide member being movable towards and away from said first guide member;

(c) a plurality of rods arranged to transmit stresses between said first and second guide members, each of said rods having an end face in the region of said second guide member;

(d) first biasing means arranged to act on said rods and to urge said second guide member towards said first guide member;

(e) second biasing means for moving said second guide member away from said first guide member against the action of said first biasing means, said second biasing means being arranged to bear against said end faces; and (f) a plurality of centering elements disposed between the support and said first guide member, said rods extending through said first guide member, and each of said centering elements having a centering opening which receives one of said rods.

20. The guide of claim 19, wherein said centering elements are annular.

21. The guide of claim 19, wherein each of said rods is provided with an abutment between said first guide member and the respective centering element.

22. A roller guide, particularly for use in continuous casting installations for steel, said guide comprising:

(a) a first guide member resting on a support and including a first carrier, and at least one first guide roller supported by said first carrier;

(b) a second guide member including a second carrier, and at least one second guide roller supported by said second carrier, said second guide member being mounted on said first guide member in such a manner that said first and second rollers cooperate to define a guide passage, and said second guide member being movable towards and away from said first guide member;

(c) a plurality of rods arranged to transmit stresses between said first and second guide members;

(d) first biasing means arranged to act on said rods and to urge said second guide member towards said first guide member;

(e) second biasing means for moving said second guide member away from said first guide member against the action of said first biasing means; and (f) connecting means for releasably connecting said rods, and thereby said first guide member, to the support.

* * * * *